United States Patent [19]

Wellenhofer et al.

[11] Patent Number: 4,953,271

[45] Date of Patent: Sep. 4, 1990

[54] INTERMINGLING NOZZLE

[75] Inventors: Herbert Wellenhofer, Bobingen; Ingolf Jacob, Untermeitingen; Josef Geirhos, Bobingen, all of Fed. Rep. of Germany

[73] Assignee: Hoechst Aktiengesellschaft, Fed. Rep. of Germany

[21] Appl. No.: 410,311

[22] Filed: Sep. 20, 1989

[30] Foreign Application Priority Data

Sep. 22, 1988 [DE] Fed. Rep. of Germany ..... 3832283

[51] Int. Cl.[5] ..... D02G 1/16; D02J 1/08

[52] U.S. Cl. ..... 28/272

[58] Field of Search ..... 28/104, 271, 272, 273, 28/274, 275, 276

[56] References Cited

U.S. PATENT DOCUMENTS 3,296,679 1/1967 Jobson ..... 28/272

3,367,100 2/1968 Hughey ..... 28/276 X

FOREIGN PATENT DOCUMENTS 3727262 2/1989 Fed. Rep. of Germany ..... 28/272

*Primary Examiner*—Werner H. Schroeder

*Assistant Examiner*—Bradley Kurtz DeSandro

*Attorney, Agent, or Firm*—Connolly and Hutz

[57] ABSTRACT

An intermingling nozzle for filaments and yarns is described. The intermingling nozzle comprises a reedlike side by side arrangement of alternate yarn channel and closing plates. In the yarn channel plate sides adjoining the closing plates, grooves are formed as yarn channels and perpendicularly thereto as blowing channels. The closing plates are rotatable with respect to the yarn channel plates, specifically between an open position, in which they give access to the yarn channels to allow yarns to be inserted, and a closed position, in which they cover up the yarn channels. The intermingling nozzle is suitable in particular for intermingling high-count yarns, for example for reinforcing fabrics and tire cords.

12 Claims, 2 Drawing Sheets

INTERMINGLING NOZZLE

Figure 1:
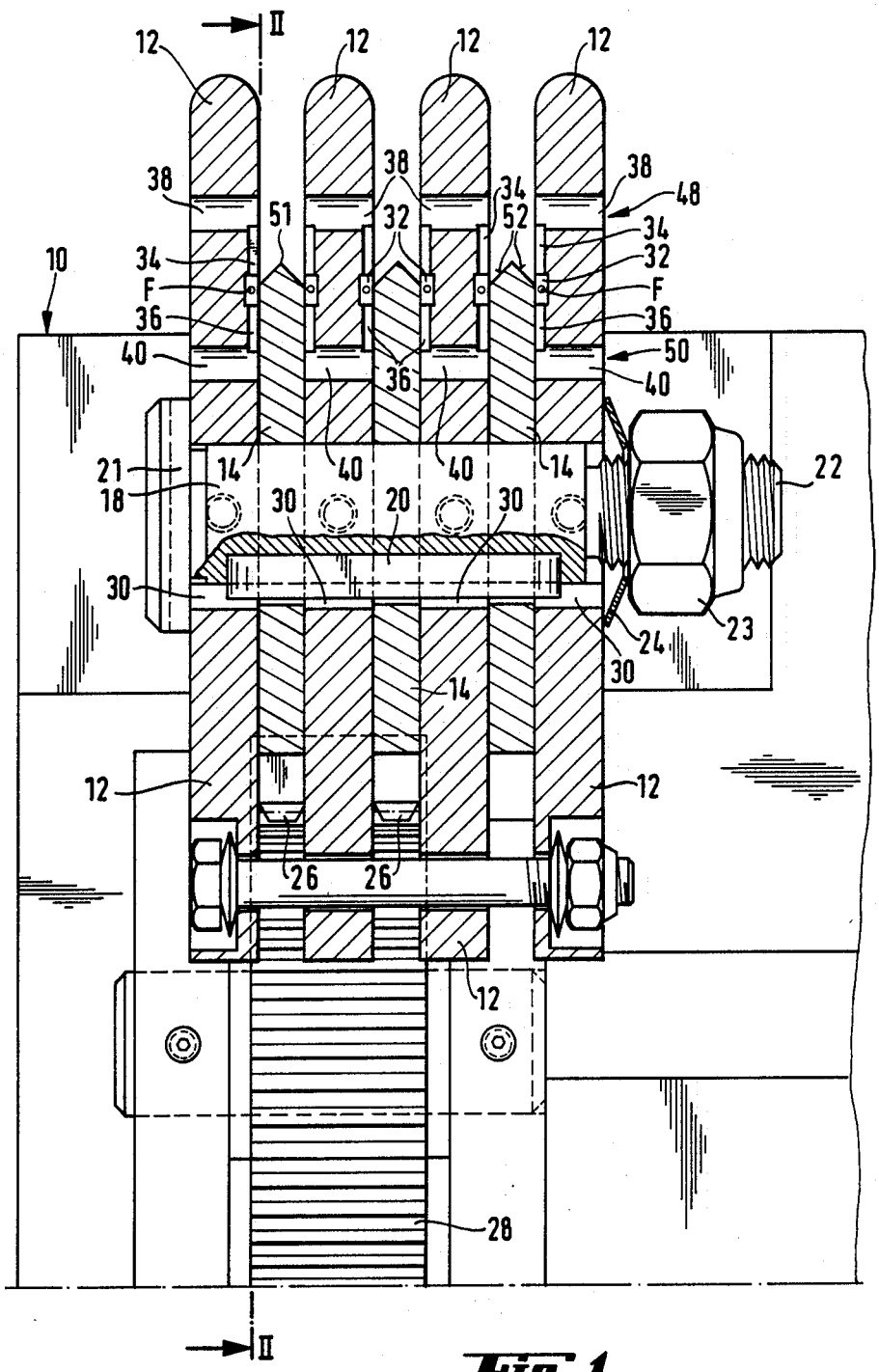

The invention relates to an intermingling nozzle for filaments or yarns, comprising a plurality of plates arranged side by side in the manner of a reed forming yarn channels which are in a parallel arrangement and blowing medium channels which end transversely in the yarn channels, the axes of the yarn channels being in a plane which extends perpendicularly to the plates.

An intermingling nozzle of this category is known from DE-A-3,019,302. In this intermingling nozzle, the plates form a blocklike arrangement in which the yarn channels are formed as a result of a straight-line gap of rectangular cross-section being left free in each case between an upper and a separate lower plate portion. With this intermingling nozzle the yarns must be threaded in individually; a threading in or subsequent addition of continuous yarns is not possible. Moreover, the pitch, i.e. the spacing of the yarn channels perpendicularly to the yarn transport direction, is comparatively large.

EP-A-216,951 discloses an intermingling nozzle of a somewhat different category where the yarn channels remain open in operation. It is true that this permits a laying in of yarns during operation, but the air consumption is correspondingly large. Moreover, there is a danger that yarns will be blown out of the yarn channels.

EP-A-262,237 and EP-A-152,919 each disclose an intermingling nozzle consisting of two mutually adjoining blocks in a horizontal plane. The blocks are provided at the mutually adjoining contact surfaces with grooves serving as yarn channels. By lifting the upper block, for example by pivoting it upward, it is then possible to insert yarns into the yarn channels. However, insertion of yarns during operation is not possible with this intermingling nozzle either, since the upper block prevents free access to the yarn channels even in the open state.

DE-A-2,840,177, finally, discloses an intermingling nozzle where cylindrical bores each hold a tubular body which contains the yarn channel and is mounted rotatably about its longitudinal axis, specifically between an open position, in which the yarn channel is freely accessible, and a closed position, in which the yarn channel is sealed off from the outside. It is true that with this intermingling nozzle it is possible to insert yarns into the yarn channels during operation, but the manufacture of the tubular bodies rotatable in the bores requires considerable manufacturing resources owing to the high accuracy of fit required. Moreover, on closing the intermingling nozzle there is a danger that the yarns or individual filaments will be trapped. Finally, a comparatively large pitch of the yarn channels is unavoidable.

It is an object of the invention to develop an intermingling nozzle of the category specified at the beginning in such a way that, despite low air consumption and a very narrow pitch of the yarn channels, it is possible to insert filaments or yarns during operation.

This object is achieved according to the invention in relation to the intermingling nozzle having the features indicated at the beginning when pairs of mutually adjoining plates consist of a stationary yarn channel plate and a mobile closing plate, of which the yarn channel plate is provided on its side which faces the closing plate with a groove which serves as a yarn channel and the closing plate is movable parallel to the plate planes between an open position which gives access to the yarn channel and a closed position which covers up the yarn channel.

This "closed position" is the operating position of the intermingling nozzle. In the nozzle according to the invention, the yarn channels are freely accessible from one side when the intermingling nozzle is in the open position. The filaments or yarns can therefore be inserted during operation, for example by shifting the entire intermingling nozzle in the direction of the yarns. Since the yarn channels are closed in the closed position, the consumption of blowing medium, in particular air, can be kept to a minimum.

The pitch of the intermingling nozzle depends solely on the thickness of the plates, so that the pitch can be made comparatively small. More particularly, if the yarn channel plates are provided with a yarn channel on both sides, the pitch of the intermingling nozzle can be made very tight.

Since the intermingling nozzle consists essentially of planar plates, the manufacturing expense is comparatively low. Nonetheless, an intermingling nozzle constructed according to the invention can produce a high intermingling performance.

An intermingling nozzle constructed according to the invention is suitable in particular for intermingling sheets of coarse-count yarns of the type used for reinforcing fabrics and/or tire cord.

Advantageous embodiments of the invention are given in the subclaims.

Figure 2:
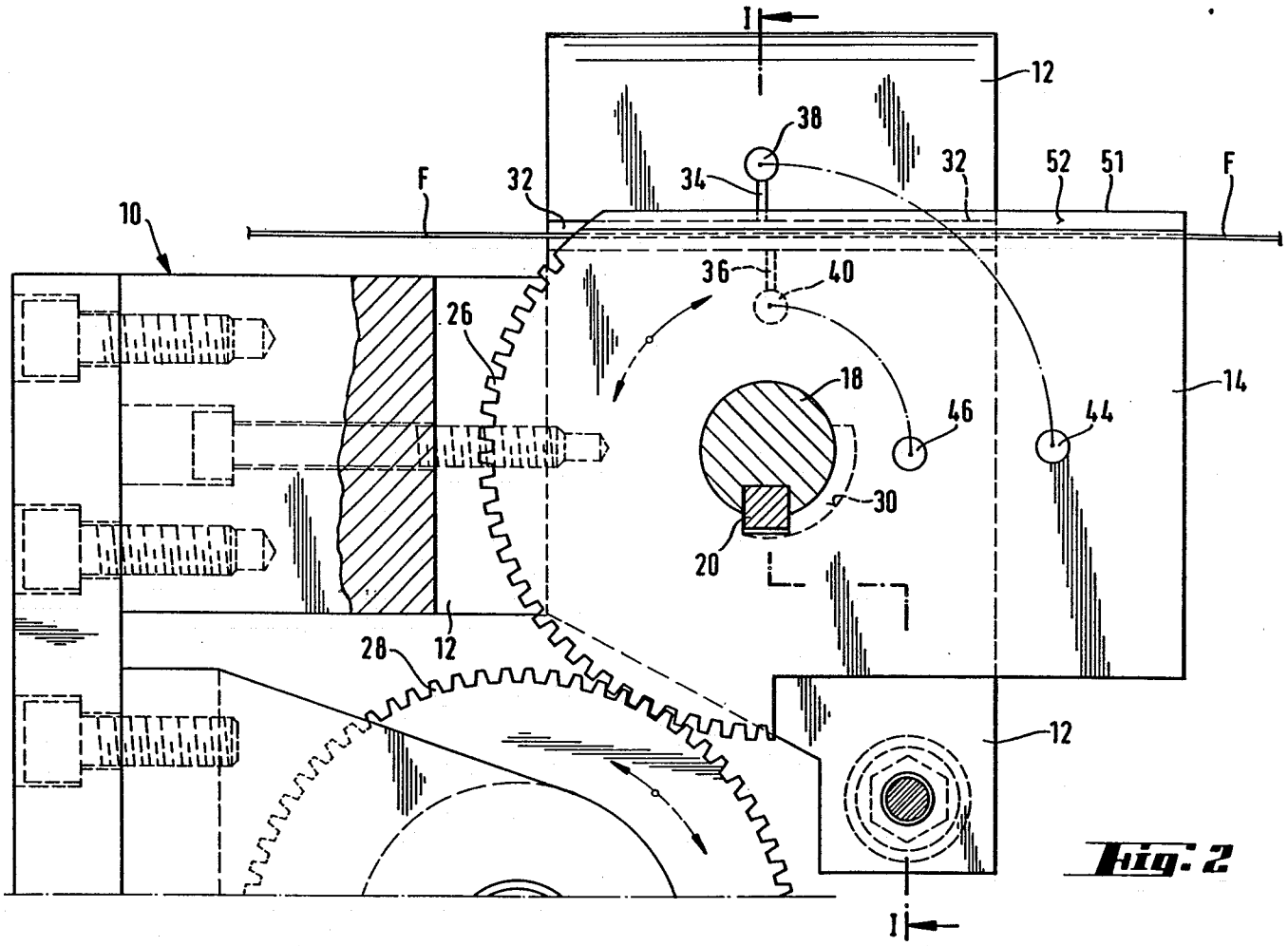

An illustrative embodiment of the invention is explained with reference to the drawing, where FIG. 1 shows a cross-section through an open intermingling nozzle perpendicular to the yarn transport direction; and FIG. 2 shows a side view of the open intermingling nozzle.

The intermingling nozzle shown in the Figures has a support 10. The support 10 supports a group of firmly attached planar yarn channel plates 12 arranged side by side and alternately with planar closing plates 14.

The closing plates 14 are mounted on a shaft 18, which is mounted rotatably in bores of the yarn channel plates 12, but are prevented from rotation by a wedge 20. The shaft 18 has at one end an abutment head 21 and at its other end a thread 22 onto which a nut 23 has been threaded. The shaft 18 and nut 23 in this arrangement and in conjunction with the plate spring 24 keep the yarn channel plates 12 and the closing plates 14 in mutual adjoinment under a given pre-tension without, however, preventing movement of the closing plates 14 in planes parallel to the yarn channel plates 12.

At least one and preferably two of the closing plates 14 are provided with a toothed segment 26 which is in engagement with a toothed wheel 28 driven by a compressed air motor (not depicted). As a result, the closing plates 14 are rotatable about the longitudinal axis of the shaft 18. The extent of the rotation of the closing plate 14 is limited to 90° by recesses 30 which are formed by the yarn channel plates 12, and which extend at 90° and into which the wedge 20 engages. In this way, the closing plates 14 are adjustable between a closed position and, displaced by 90° therefrom, an open position which is shown in FIGS. 1 and 2.

The yarn channel plates 12 are each provided on their sides which face the closing plates 14 with a straight-line continuous groove 32 of rectangular cross-section, which serves as a yarn channel. Each yarn channel groove 32 branches at right angles and on opposite sides into a straight-line groove which serves as blowing channel for blowing an intermingling medium, in particular air, into the yarn channel. The blowing channel grooves 34 and 36 formed in the sides of the yarn channel plates 12 each end in a bore 38 or 40 respectively extending perpendicularly through the yarn channel plate 12. The closing plates 14 contain corresponding bores 44 and 46 respectively which, in the closed position of the closing plates 14, become flush with the bores 38 and 40 respectively of the yarn channel plates 12 and thus form feed channels 48 and 50 respectively for feeding in the blowing medium. The supply of the feed channels 48 and 50 with the blowing medium is effected by way of the outside yarn channel plates 12 via a device (not depicted) which automatically interrupts the supply of the blowing medium as the intermingling nozzle is opened.

The closing plates 14 are provided with a straight-line outer rim 51 which, in the open position of the closing plates 14, extends parallel to the yarn channel grooves 32. The arrangement and construction of these yarn channel plates 12 and closing plates 14 is such that the closing plates 12 in the open position allow completely free access to the yarn channel grooves 32 in the yarn transport direction but only partial access perpendicularly to the yarn transport direction, so that, although the yarns F can be inserted into the yarn channels, they have a certain support therein. The outer rims 51 of the closing plates 14 are provided with rooflike chamfers 52 which in the open position of the closing plates are inclined toward the yarn channels in order to facilitate insertion of the yarns F.

The mutually adjoining sides of the yarn channel plates 12 and of the closing plates 14 are honed or lapped to obtain a high surface quality, so that satisfactory mutual contact of the yarn channel and the closing plates is ensured. If the closing plates 14 are rotated out of their open position (shown in FIGS. 1 and 2) by 90° into their closed position, they seal off the yarn channel grooves 32 absolutely tightly without any risk of trapping the yarns F between the mutually adjoining side surfaces of the yarn channel and closing plates. Before use, the entire intermingling nozzle is moved by means of the slidable support 10 out of the area of the yarns. At this time the closing plates 14 are in their open position (which is shown in the drawings). Once the sheet of yarns has then been given the desired arrangement and has been set in motion, the intermingling nozzle is moved in the direction of the moving yarns F (upward in FIGS. 1 and 2). In the course of this movement, the yarns F slide over the chamfers 52 into the yarn channel grooves 32 without their transport having to be interrupted. Thereafter the closing plates 14 are moved via the toothed drive 26, 28 into their closed position in which they seal the yarn channels and connect the blowing channels to the feed channels 48, 50 formed by the bores 38, 44 and 40, 46. At the same time, the supply of blowing medium (preferably air) is initiated automatically in order to intermingle the yarns F passing through the yarn channels.

Even though the depicted illustrative embodiment shows four yarn channel plates and three closing plates, it will be readily understood that the yarn channel and closing plates can also be grouped together in larger groups, for example of 20 to 25 plates.

As mentioned at the beginning, the intermingling nozzle described is usable in particular in the drawing of sheets of coarse-count yarns of the type used for reinforcing fabrics or tire cords. They are yarns having a count of about 500 to 2500 dtex, usually between 1000 and 1700 dtex, with a filament denier of 3 to 15 dtex, preferably 5 to 8 dtex. The drawing of these yarns and hence also the intermingling usually takes place at speeds of 100 to 500 m/min on continuous lines. The yarn tension in the intermingling zone is usually between 0.01 and 0.1 cN/dtex.

The depicted intermingling nozzle permits a very tight pitch of the yarn channels, for example of 4 to 6 mm, but even down to 2 mm. This makes it possible to guide the yarns close together and thus to obtain good utilization of the godets and heating elements of the drawing units.

In a concrete illustrative embodiment, a tire cord of 1440 dtex, a transport speed of 220 m/min, a pitch of 1 yarn/4.8 mm, a yarn tension of 40 cN/1440 dtex and an air throughput of 3.5 standard $m^3/h$ gave an needle test value (Rothschild Entanglement Tester R2040) of 120 to 200 mm.

We claim:

1. An intermingling nozzle for filaments or yarns, comprising a plurality of plates arranged side by side in the manner of a reed forming yarn channels which are in a parallel arrangement and blowing medium channels which end transversely in the yarn channels, the axes of the yarn channels being in a plane which extends perpendicularly to the plates, wherein pairs of mutually adjoining plates consist of a stationary yarn channel plate (12) and a mobile closing plate (14), of which the yarn channel plate (12) is provided on its side which faces the closing plate (14) with a groove (32) which serves as a yarn channel and the closing plate (14) is movable parallel to the plate planes between an open position which gives access to the yarn channel and a closed position which covers up the yarn channel.

2. The intermingling nozzle as claimed in claim 1, wherein the closing plate (14) is rotatable for performing the movement between the closed and the open position.

3. The intermingling nozzle as claimed in claim 2, wherein the closed position and the open position of the closing plate (14) are offset relative to each other by 90°.

4. The intermingling nozzle as claimed in claim 1, wherein the yarn channel and closing plates (12, 14) are arranged alternately with one another and at least the inner yarn channel plates are provided on each side with a yarn channel groove (32).

5. The intermingling nozzle as claimed in claim 1, wherein the closing plate (14) in the open position gives only partial access to the yarn channel groove (32) perpendicular to the yarn transport direction.

6. The intermingling nozzle as claimed in claim 1, wherein a circumferential edge of the closing plate (14), which in the open position extends parallel to the yarn channel, is provided with a chamfer (52) to facilitate insertion of the yarn (F).

7. The intermingling nozzle as claimed in claim 1, wherein the circumferential edge of the closing plate (14) is provided on both sides with a chamfer (52) each.

8. The intermingling nozzle as claimed in claim 1 wherein the blowing channels each consist of a groove (34) formed in one side of the yarn channel plate (12).

9. The intermingling nozzle as claimed in claim 8, in which the blowing channels are connected to a common feed channel extending perpendicularly to the plate planes, wherein the feed channel (48; 50) consists of bores (38; 40) in the yarn channel plates (12) and bores (44; 46) in the closing plates (14), which are flush with one another in the closed position of the closing plates (14).

10. The intermingling nozzle as claimed in claim 1, wherein the yarn channel and closing plates (12, 14) are grouped together in a plurality of groups, the closing plates (14) of one group being moveable together.

11. The intermingling nozzle as claimed in claim 10, wherein at least one of the closing plates (14) is provided with a toothed sector (26) which is in engagement with a drivable toothed wheel (28).

12. The intermingling nozzle as claimed in claim 1, wherein the intermingling nozzle is slidable as a whole to permit insertion of the yarns (F).

* * * * *